United States Patent [19]

Masuda et al.

[11] Patent Number: 5,017,946

[45] Date of Patent: May 21, 1991

[54] INK JET RECORDING HEAD HAVING SURFACE TREATMENT LAYER AND RECORDING EQUIPMENT HAVING THE HEAD

[75] Inventors: Kazuaki Masuda, Sagamihara; Akio Saito, Yamato; Toshio Kashino, Chigasaki; Takashi Watanabe, Hiratsuka, all of Japan

[73] Assignee: Canon Kabushiki Kaisha, Tokyo, Japan

[21] Appl. No.: 512,606

[22] Filed: Apr. 24, 1990

Related U.S. Application Data

[63] Continuation of Ser. No. 382,219, Jul. 20, 1989, abandoned.

[30] Foreign Application Priority Data

Jul. 21, 1988 [JP] Japan ..... 63-180312
Jul. 21, 1988 [JP] Japan ..... 63-180313

[51] Int. Cl.[5] ..... B41J 2/14; B41J 2/05

[52] U.S. Cl. ..... 346/140 R; 428/422; 428/448

[58] Field of Search ..... 346/140; 428/447, 448, 428/422

[56] References Cited

U.S. PATENT DOCUMENTS

| | | | |
|---|---|---|---|
| 3,886,865 | 6/1975 | Ohto | 101/465 X |
| 4,368,476 | 1/1983 | Uehara | 346/140 |
| 4,600,651 | 7/1986 | Aufdermarsh | 428/422 |
| 4,643,948 | 2/1987 | Diaz | 428/422 |

FOREIGN PATENT DOCUMENTS 178065 9/1985 Japan .

OTHER PUBLICATIONS

Shih, Peter T. K.; Antiwetting Organosilanes and Composite Films for Ink Jet Nozzles; Xerox Disc Jr., V7N5 S/0 1982, p. 321.

*Primary Examiner*—Joseph W. Hartary
*Attorney, Agent, or Firm*—Fitzpatrick, Cella, Harper & Scinto

[57] ABSTRACT

An ink jet recording head having ink-liquid-repellent surface treatment portions close to the discharging ports, wherein said ink-liquid-repellent treatment surface portions are formed by polymerizing and curing a composition containing a fluorine type polymer with a molecular weight of 2,000 or more which is insoluble in water and soluble in organic solvent and a polyfunctional monomer and/or a polyfunctional oligomer having two or more (meth)acryloyl groups in the molecule through a silane coupling agent.

12 Claims, 3 Drawing Sheets

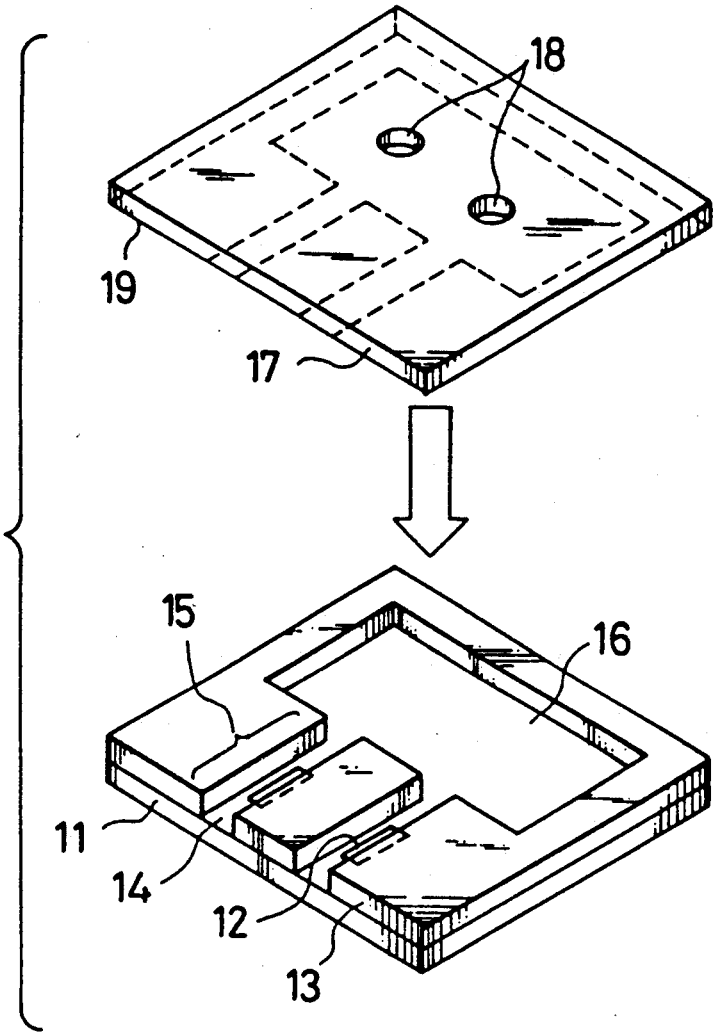
FIG. 1
PRIOR ART
FIG. 2
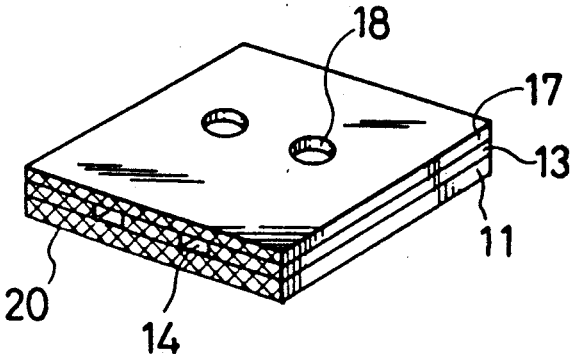

INK JET RECORDING HEAD HAVING SURFACE TREATMENT LAYER AND RECORDING EQUIPMENT HAVING THE HEAD

This application is a continuation of application Ser. No. 382,219, filed July 20, 2989, now abandoned.

BACKGROUND OF THE INVENTION

1. Field of the Invention

The present invention relates to an ink jet recording equipment used in copy machine, facsimile, word processor, out put printer for host-computer, out put printer for VTR etc., particularly to an ink jet recording head in which ink-liquid-repellent treatment is applied at the discharging port (orifice) peripheral portion of the recording head used for said recording equipment, and to an ink jet recording equipment having said recording head.

2. Related Background Art

There has been known in the art an ink jet recording device which performs recording by discharging a recording liquid (ink) through a discharging port (orifice) of a recording head as a recording device excellent with respect to low noise, high speed recording, etc.

FIG. 1 shows a schematic perspective view for explaining the constitution of conventional ink jet recording head.

In this recording head, on a substrate 11 as a support formed of glass, ceramic or single crystal silicon substrate, a discharging energy-generating element 12 is located, and a liquid channel 15 and an orifice 14 corresponding to the discharging energy-generating element 12, and further a liquid chamber 16 are formed by patterning of a cured photosensitive resin film 13 according to photolithography. On the cured photosensitive resin film 13, a ceiling plate 17 formed of, for example, glass, ceramic, metal, resin, etc. is laminated and secured with an adhesive 19. Also, a recording liquid feeding opening 18 is formed at its ceiling plate 17.

In the recording head with such constitution, the physical properties (physical characteristics) of the surfaces of the substrate 11, the cured photosensitive resin film 13 and the ceiling plate 17 surrounding the orifice 14 are extremely important in permitting the recording liquid to be discharged constantly stably for performing record. More specifically, if the recording liquid comes around the outer surface portion of the orifice 14 (orifice peripheral portion) to form a liquid pool at a part thereof, the recording liquid in the liquid channel 15 when discharged through the orifice 14 will come out in its flying direction from the normal predetermined direction, and further due to unstable state of the liquid pool, its flying direction will be disturbed every time of discharging, whereby no stable liquid discharging can be effected to reach the limit improving recording quality.

Further, if the outer surface portion as a whole of the orifice 14 is covered with the film of the recording liquid, the so called splash phenomenon occurs to cause scattering of the recording liquid, whereby good recording can not be performed. Also, if the liquid pool covering over the outer surface portion of the orifice becomes greater, liquid discharging per se through the recording head may sometimes become impossible.

FIG. 1 shows one example of recording head preferably to good recording. In this recording head, as the members surrounding the orifice, there have been frequently used different materials such as silicon (substrate 11), glass (ceiling plate 17), resin (cured photosensitive resin film 13). The present inventors have found that the recording liquid will be leaked through the portion of the material most readily leakable among the three kinds of materials in the vicinity of the orifice by searching fully discharing of recording liquid at such recording head. For example, it has been found that since glass is the lowest in surface tension among the three kinds of materials as mentioned above relative to conventional ink (recording liquid), ink will be leaked through that portion.

As described above, in the recording head, if liquid pooling occurs at the peripheral portion of orifice, no stable discharging can be effected. This tendency is exhibited very markedly in performing high precision recording by increasing the nozzle density or in aiming at driving at high frequency, namely high speed recording. In other words, this tendency is a technical problem to improve more performance of the recording head when high speed and high quality recording is desired.

Accordingly, as shown in FIG. 2, a large number of proposals have been made to solve the above problem by applying the so called ink-liquid-repellent surface treatment (water-repellent treatment for aqueous ink and oil-repellent treatment for oily ink) on at least the peripheral portion of the orifice 14 to form a water-repelling treated layer 20 which repels ink. As the water-repellent treating agent to be used for the water-repellent treatment, for example, various silicone oils have been included. By the present inventors' knowledge, it is necessary to consider the relationship between a recording head and a recording equipment having the abovementioned recording head in order to perform record by use of the abovementioned recording head.

The surface treatment layer 20 to be formed on the ink jet recording head cannot be practical, unless it is not only good in ink-liquid-repellency but also sufficient in durability of the surface treatment layer in carrying out conventional ink jet recording. In the following, its durability is to be described.

When practicing the ink jet recording method, even if ink-liquid-repellent treatment may be applied at the orifice peripheral portion, for performing good discharging, the restoration operation of wiping the orifice surface with an absorbing material such as polyurethane foam, etc. to absorb the ink attached thereon is frequently done. Accordingly, the surface treatment layer is required to have adhesion to the extent that it will not be peeled off even when rubbed with an absorbing material and abrasion resistance, etc. to the extent that the layer will not be broken. If these durabilities are insufficient, although the ink-liquid-repellent effect may be exhibited at the initial stage, in the course of use of the head, the ink-liquid-repellent treated layer will be gradually peeled off or dropped off, until no ink-liquid-repellent effect can be exhibited and no stable discharging printing can be done.

With regard to such durability required for the ink jet recording head, there are many problems to be improved in order to enhance recording quality.

As shown in the ink jet head of FIG. 1 in the case that members forming the orifice are composed of a plurality of different materials, a surface treatment layer capable of keeping good adhesion to all materials of them, especially even in long period recording, must be formed. The surface treatment layer formed with the surface-treating agent of the prior art has yet room for improvement in this point.

The inventors has searched a surface-treating agent of ink-liquid-repellency. As the result, the surface-treating agents of the following composition are used for surface-treatment of ink-liquid-repellency for the recording head.

(a) A UV-ray polymerization curable composition containing a fluorine type polymer with an average molecular weight of 2,000 or more which is substantially insoluble in water and soluble in organic solvent and a polyfunctional monomer or a polyfunctional oligomer having two or more (meth)acryloyl groups in the molecule.

(b) A compound having at least one reactive group selected from the group consisting of fluoroalkyl groups, fluoroallyl groups, fluorocycloalkyl groups, fluoroalkallyl groups and fluoroalkylallyl groups and a silazane group.

For example, when the surface treatment of the above head (the substrate 11 of silicon, the ceiling plate 17 of glass, the cured resin film 13) is effected by the composition described in (a) or (b), a surface treatment layer improved in durability as compared with the case of using the surface-treating agent of the prior art was obtained.

The present inventors further have continued many experiments. As the result, it has been found that, even by use of the composition described in (a), ink-liquid-repellent effect reduces after use for a long period by peeling off of the agent.

It is assumed that this matter is caused by that the composition described in (a) exhibits particularly excellent adhesion to the organic material portion of the cured photosensitive resin film, but is not still unsatisfactory in adhesion to inorganic material portions such as glass and silicon.

On the other hand, even by use of the composition described in (b), the agent of (b) peals off after use for a long period in the similar manner to that in the composition (a).

It is assumed that the reasons for this phenomenon is reversed. That is to say, the composition described in (b) exhibits particularly excellent adhesion to glass and silicon, but is still insufficient in adhesion to organic material portion such as resin.

The ink jet recording head having the constitution as previously shown as a suitable embodiment is constituted of plural kinds of organic and inorganic materials from aspects of manufacturing, performance, cost, etc. Accordingly, there is further room for improvement of the above (a) and (b) with respect to practical performance of adhesion to both organic and inorganic materials.

SUMMARY OF THE INVENTION

The present invention has been accomplished for solving such task, and its object is to provide a recording head and a recording equipment capable of performing good record stably for a long period.

Another object of the present invention is to provide a recording head and a recording equipment having ink-liquid-repellent surface treatment layer excellently adhesive to all materials capable of constructing the recording head.

A further object of the present invention is to provide a recording head and a recording equipment keeping well ink-liquid-repellency for a long period capable of being applied even under the severe conditions for applying good surface-treatment in which the recording head is constituted of plural kinds of materials such as organic and/or inorganic materials.

According to one aspect of the present invention, there is provided an ink jet recording head having ink-liquid-repellent surface treatment portions close to the discharging ports, wherein said ink-liquid-repellent treatment surface portions are formed by polymerizing and curing a composition containing a fluorine type polymer with a molecular weight of 2,000 or more which is insoluble in water and soluble in organic solvent and a polyfunctional monomer and/ or a polyfunctional oligomer having two or more (meth)acryloyl groups in the molecule through a silane coupling agent.

According to another aspect of the present invention, there is provided an ink jet recording head having ink-liquid-repellent surface treatment portions close to the discharging ports, wherein said ink-liquid-repellent surface treatment portions have a polymerization cured product of the following composition (a) and a polymerization cured product of the following composition (b):

composition (a):

a composition containing a fluorine type polymer with a molecular weight of 2,000 or more which is insoluble in water and soluble in organic solvent and a polyfunctional monomer and/or a polyfunctional oligomer having two or more (meth)acryloyl groups in the molecule;

composition (b):

a composition containing at least one of compounds having at least one reactive group selected from the group consisting of fluoroalkyl groups, fluoroallyl groups, fluorocycloalkyl groups, fluoroalkallyl groups and fluoroalkylallyl groups and a silazane group.

According to still another aspect of the present invention, there is provided a recording equipment performing record by ink on a recording medium, which comprises a recording means comprising discharging surfaces and discharging energy generators for generating energy utilized to discharge an ink from discharging ports, a carrying means for carrying the recording medium, and a driving means for driving the discharging energy generators, said discharging surfaces having ink-liquid-repellent surface treatment portions close to the discharging ports, and said ink-liquid-repellent surface treatment portions being formed by polymerizing and curing a composition containing a fluorine type polymer with a molecular weight of 2,000 or more which is insoluble in water and soluble in organic solvent and a polyfunctional monomer and/or a polyfunctional oligomer having two or more (meth)acryloyl groups in the molecule through a silane coupling agent.

BRIEF DESCRIPTION OF THE DRAWINGS

FIG. 1 is a schematic perspective view for illustrating the constitution of the ink jet recording head.

FIG. 2 is a schematic perspective view of the ink jet recording head to which the present invention is applicable.

DETAILED DESCRIPTION OF THE PREFERRED EMBODIMENTS

Figure 3:
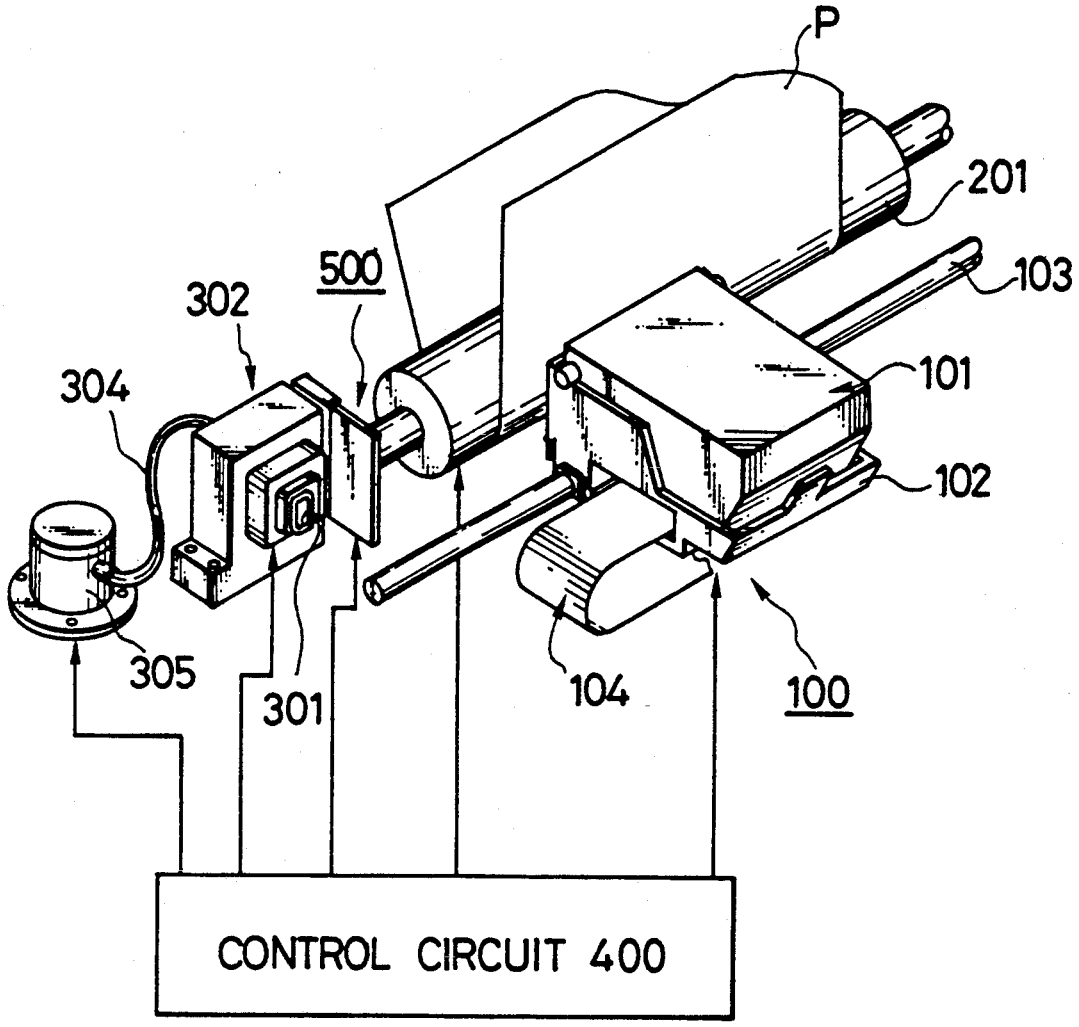
FIG. 3 is a schematic perspective view of the ink jet recording equipment to which the present invention is applicable.

Referring the drawings, the present invention is explained. It is our intention that the invention be not limited by any of the details of description and the following, examples and that various changes and modifications may be made in the invention without departing from the spirit and scope thereof.

A preferable embodiment according to the present invention is an ink jet recording head having ink-liquid-repellent surface treatment portions at least at the orifice peripheral portion, wherein said surface treatment portions is formed by polymerizing and curing a composition containing a fluorine type polymer with a molecular weight of 2,000 or more which is insoluble in water and soluble in organic solvent and a polyfunctional monomer and/or a polyfunctional oligomer having two or more (meth)acryloyl groups in the molecule through a silane coupling agent.

The abovementioned recording head is made by a preferable embodiment described below.

A silane coupling agent is coated on at least the orifice peripheral portion to have first the inorganic material bonded to the silane coupling agent, and the water-repellent treatment with the above UV-ray polymerization curable composition is applied on the coated surface.

The silane coupling agent to be used in the present invention is not particularly limited, provided that it can be well bonded to the material constituting the orifice peripheral portion, and also well bonded to the surface treatment layer, namely can aid sufficiently adhesion to the material constituting the orifice and the surface treatment layer, and may include, for example, an acrylic silane coupling agent and a mercapto type silane coupling agent are preferable. For the acrylic silane coupling agent, A-174 (trade name, manufactured by Nippon Yunika) is exemplified; and for the mercapto type silane coupling agent, A-189 (trade name, manufactured by Nippon Yunika) is exemplified.

The surface-treating agent to be used for ink-liquid-repellent surface treatment in the present invention is not particularly limited, provided that it is a composition containing the fluorine polymer and the monomer as described above, but it should desirably one capable of forming easily a water-repellent treated layer excellent in water repellency, etc. necessary for the orifice peripheral portion of the ink jet recording head as described above, and, for example, a photoradical polymerization type resin composition is preferable. For the photoradical polymerization type resin composition, DEFENSA 7702 (trade name, manufactured by Dainippon Ink Kagaku Kogyo) is exemplified.

Another embodiment according to the present invention is an ink jet recording head having ink-liquid-repellent surface treatment portions at least at the orifice peripheral portion, wherein said surface treatment portions have a polymerization cured product of the following composition (a) and a polymerization cured product of the following composition (b):

composition (a):

a composition containing a fluorine type polymer with a molecular weight of 2,000 or more which is insoluble in water and soluble in organic solvent and a polyfunctional monomer and/or a polyfunctional oligomer having two or more (meth)acryloyl groups in the molecule;

composition (b):

a composition containing at least one of compounds having at least one reactive group selected from the group consisting of fluoroalkyl groups, fluoroallyl groups, fluorocycloalkyl groups, fluoroalkallyl groups and fluoroalkylallyl groups and a silazane group.

A preferable embodiment of the process for the manufacture of the recording head according to the present invention is carried out by performing the ink-liquid-repellent surface treatment by applying both of the treatments by use of the compositions (a) and (b).

The treatments by use of the compositions of (a) and (b) may be conducted in any desired order. However, it is preferable to perform the treatment with (b) first, and then the treatment with (a).

In the following, the compositions (a) and (b) in the present invention and treatments by use thereof are described in detail.

The composition (a) is not particularly limited, provided that it is a composition containing the fluorine polymer and the monomer as described above, but it should desirably one capable of forming easily a surface treatment layer excellent in ink-liquid repellency, etc. necessary for the orifice peripheral portion of the ink jet recording head as described above, and photoradical polymerization type resin composition is exemplified as preferable example.

The composition (b) is not particularly limited, provided that it contains at least one compound having the reactive groups as mentioned above, but preferably one capable of forming easily the surface treatment layer excellent in ink-liquid repellency, etc. necessary for the orifice peripheral portion of the ink jet recording head as described above, and may include, for example, $CF_3(CF_2)_4Si(NH_2)_3$, $CF_3(CF_2)_4Si(NH_2)_2NHSi(NH_2)_2(CF_2)_4CF_3$ as preferable examples.

The ink-liquid-repellent surface treatment layer as herein mentioned refers to the site where the cured product of the surface at the portion subjected to the surface treatment in the present invention, including also the case which is not in laminar state, for example, the case when the cured products exist in spots uniformly or nonuniformly.

Said surface treatment layer may be one showing ink-liquid repellency upon being finally used as the recording head.

In the recording head according to the present invention, number of orifices, arrangement density thereof, shape thereof etc. can be suitably selected.

The present invention sufficiently exerts its effect even at the recording head having a complicating shape and a high arrangement density of 8 lines/mm or more which the application of the conventional surface treatment layer is difficult.

In the recording head, for each discharging port, one or more electricity-heat convertor are provided as the discharging energy-generating element, in which heat is generated by current based on the recording signal.

Bubble is generated by phase change of the ink by the heat energy. The ink is discharged from the discharging port by volume expansion and volume contraction of the bubble to form at least one flying liquid-droplet and the perform record.

The abovementioned head utilizing heat energy is preferably used in a type having an ink tank for holding ink to be supplied as one body in order to maximize the merit of miniaturization of the head.

Referring FIG. 3, an equipment having the abovementioned liquid jet recording head is illustrated as one suitable example.

In FIG. 3, 101 is a head, 102 a carriage, 103 a rail, 104 a flexible wiring plate, 302 a capping equipment, 301 a cap, 304 a suction tube, 305 a suction pump, 201 a platen and P a recording paper.

The head 101 is loaded on the carriage 102. Thus the electric connection and the location are effected. The carriage 102 is controlled along the rail 103 by a control circuit 400 and goes and returns with a driving means not shown in the figure. The flexible wiring plate 104 transmits the driving signal from the equipment body to an electric contact point not shown in the figure of the carriage 102.

The capping means 302 has the cap 301. The capping means is constructed so that the cap 301 covers the discharging portion of the head when the head comes to the capping position by movement of the carriage 102. When the suction pump 305 is drived at this state (capping state), the ink is sucked from the discharging port of the head through the suction tube 304 by driving of the suction pump 305 to restore and/or keep the function of the head.

As shown in FIG. 3, the equipment may be made in the form in which the recording head is fixed to the carriage 102 without an ink tank and the ink is supplied from an ink tank loaded on the equipment body by use of the ink-supplying tube. Many variation can be performed within the scope of the present invention.

The capping equipment is illustrated about the suction mechanism in the above description. However, the construction of the capping equipment is not limited to the abovementioned construction provided that the function of the head is maintained, and that the function of restoration of poor discharging etc. can be effected. In some case, it is possible that the recording equipment has no capping equipment. However, it is desirable that the recording equipment has the capping equipment in order to perform recording more certainly.

500 is a cleaning blade having an elastic sheet for wiping the surface on which the discharging port is arranged.

The recording head is constructed so that the wipe by the blade 500 is effected, for example, every one scanning etc. if desired.

EXAMPLE 1

First, as shown in FIG. 1, a heat-generating element (discharging energy-generating element) 12 was provided on a substrate 11 made of silicon. Although not shown in FIG. 1, at both ends of the heat-generating element 12, conductor wirings for sending signals to the heat-generating element were applied. Next, on the substrate 11 was laminated a photosensitive dry film 13 [manufactured by Tokyo Oka, Ordil (trade name)], and then an orifice 14, a liquid channel 15 and a liquid chamber 16 were formed. Further, a ceiling plate 17 made of glass having a feeding opening 18 opened was adhered by lamination through an adhesive 19 on the cured photosensitive resin film 13.

The ink jet recording head constituted as described above was placed in a $UV/O_3$ washing tank and the surface including the orifice 14 was washed.

Next, A-174 (trade name, Nippon Yunika) which is an acrylic silane coupling agent was dissolved in ethanol to provide a solution of 2% by weight. The solution was coated with a brush onto the surface including the orifice 14, and heated at 80° C. for 10 minutes.

Subsequently, distilled water was filled in the liquid channel 15, and then the head was dipped in a solution of a photoradical polymerization type resin composition DEFENSA 7702 (Dainippon Ink Kagaku Kogyo, trade name) as the surface treatment agent capable of giving water repellency diluted to 100-fold with Freon TF (manufactured by Daikin K.K., Daifreon S-3), drawn up and dried on air. Thereafter, UV-ray of 10 $J/cm^2$ was irradiated to cure the resin composition to manufacture the ink jet recording head of the present invention as shown in FIG. 1.

The head thus manufactured was referred to as "sample 1".

EXAMPLE 2

Except for using 2% by weight of a solution of a mercapto type silane coupling agent A-189 (Nippon Yunika, trade name) dissolved in ethanol in place of the acrylic silane coupling agent solution, an ink jet recording head of the present invention was manufactured in the same process for the preparation as in Example 1.

The head thus manufacture was referred to as "sample 2".

COMPARATIVE EXAMPLE 1

An ink jet recording head was prepared in the same manner as in Example 1 except for carrying out no silane coupling agent treatment.

The head thus manufactured was referred to as "sample 3".

Evaluation of durability:

For the ink jet recording heads (samples 1-3) manufactured in Examples 1, 2 and Comparative example 1, abrasion durability tests were conducted as described below.

Figure 4A:
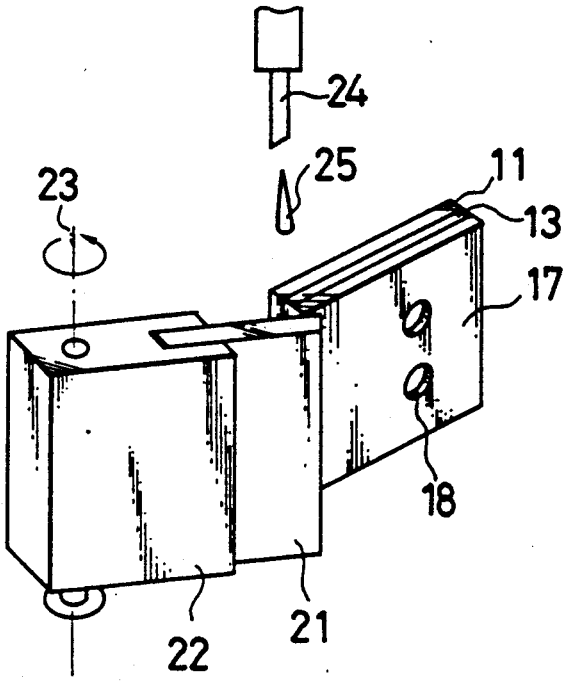
FIGS. 4A and 4B are respectively a schematic view of the equipment for the durability test of the recording head according to the present embodiment and comparative example.
Figure 4B:
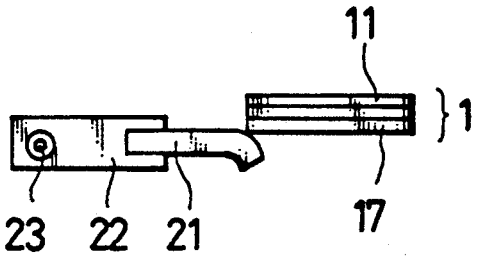

FIG. 4A and 4B are respectively perspective view and plan view showing the outline of the abrasion durability test.

This equipment is an abrasion testing machine in the conditions approximate to the movement conditions of the abovementioned recording equipment substantially illustrated by use of FIG. 3.

As shown in the Figures, a silicone rubber plate 21 having the same construction as that the cleaning blade is held on a member 22, and by rotation of the member 22 with the rotational shaft 23 as the center, the surface treatment layer 20 of the ink jet recording head 1 was frictioned with the silicone rubber plate 21 under a pressure of about 10 $g/cm^2$. Also, for simulating the friction approximate to the state under real use state, ink droplets 25 of an aqueous ink can be added dropwise onto the frictioned portion from an ink dropping device 24.

By use of the device, durability tests were conduced for 1,000 to 20,000 times at an ink dropping rate of one drop/sec. The head was dismantled after 1,000 times, 5,000 times, 10,000 times and 20,000 times, and printing was conducted and the state was observed. The results are shown in Table 1. The respective marks shown in Table 1 show the states of the printing obtained, o indicating good state of printing, Δ the common state of printing, and x the bad state of printing. Judgement of goodness and badness of printing was conducted by both measurement of the deviated amount of the shot points of dots and organoleptic test by visual observation.

Table 1 shows the average evaluation.

TABLE 1

| | Sample 1 | Sample 2 | Sample 3 |
|---|---|---|---|
| 1000 times | o | o | o |
| 5000 times | o | o | x |
| 10000 times | o | o | — |
| 20000 times | o | Δ | — |

o . . . good
Δ . . . common
x . . . bad

As is apparent from the results shown in Table 1, the recording head (Sample 3) of Comparative example 1 became poorer in state of printing after 5,000 times of friction. This is because the surface treatment layer was peeled off. As compared with that, the heads (Samples 1 and 2) of Examples 1 and 2 were good or common in the state of printing even up to 20,000 times of friction.

As described above, since a surface treatment layer excellent in ink-liquid repellency and durability is formed at the orifice peripheral portion in the ink jet recording head of the present invention, constantly stable discharging printing can be done to give good printing.

Also, it has been found that the surface treatment layer is excellent in adhesion to inorganic materials, and therefore particularly useful for use in a recording head in which an inorganic material is used as one of the constituent materials of the orifice.

EXAMPLE 3

First, as shown in FIG. 1, a heat-generating element (discharging energy-generating element) 12 was provided on a substrate 11 made of silicon. Although not shown in FIG. 1, at both ends of the heat-generating element 12, conductor wirings for sending signals to the heat-generating element were applied. Next, on the substrate 11 was laminated a photosensitive dry film 13 [manufactured by Tokyo Oka, Ordil (trade name)], and then an orifice 14, a liquid channel 15 and a liquid chamber 16 were formed. Further, a ceiling plate 17 made of glass having a feeding opening 18 opened was adhered by lamination through an adhesive 19 on the cured photosensitive resin film 13.

The ink jet recording head constituted as described above was placed in a UV/$O_3$ washing tank and the surface including the orifice 14 was washed.

Next, distilled water was filled into the respective liquid channels 15, and the head was dipped in a 2% by weight Freon TF (manufactured by Daikin, Difreon S-3) solution of a mixture of $CF_3(CF_2)_4Si(NH_2)_3$ and $CF_3(CF_2)_4Si(NH_2)_2NHSi(NH_2)_2(CF_2)_4CF_3$ as the first surface treating agent, drawn up and dried on air. Then, distilled water was removed into the respective liquid channels 15, and the reaction was effected for curing at 100° C. for 30 minutes.

Subsequently, the head was dipped in a solution of a photoradical polymerization type resin composition DEFENSA 7702 (Dainippon Ink Kagaku Kogyo, trade name) as the second surface treatment agent capable of giving water repellency diluted to 100-fold with Freon TF, drawn up and dried on air. Thereafter, UV-ray of 10 J/cm$^2$ was irradiated to cure the resin composition to manufacture the ink jet recording head (Sample 4) of the present invention as shown in FIG. 2.

EXAMPLE 4

Except for reversing the order of the first surface treatment and the second surface treatment, an ink jet recording head (Sample 5) of the present invention having a water-repellent surface treatment layer was manufactured in the same manner as in Example 3.

EXAMPLE 5

Except for using a 5% by weight Freon TF solution of $CF_3(CF_2)_4Si(NH_2)_3$ as the first surface treatment agent, an ink jet recording head of the present invention having a water-repellent surface treatment layer was manufactured in the same manner as in Example 3.

EXAMPLE 6

Except for reversing the order of the first surface treatment and the second surface treatment, an ink jet recording head (Sample 7) of the present invention having a water-repellent surface treatment layer was manufactured in the same manner as in Example 3.

Samples 8 and 9 were manufactured by the following comparative examples 2 and 3 for the comparison with the above samples 4–7 according to Examples 3–6.

COMPARATIVE EXAMPLE 2

An ink jet recording head (Sample 8) was manufactured in the same manner as in Example 3 except for carrying out no first surface treatment.

COMPARATIVE EXAMPLE 3

An ink jet recording head (Sample 9) was manufactured in the same manner as in Example 3 except for carrying out no second surface treatment. Evaluation of durability:

For the ink jet recording heads (Samples 4–9) manufactured in Examples 3 to 6 and Comparative examples 2 and 3, abrasion durability tests were conducted as mentioned above by use of the equipment shown in FIG. 4.

By use of the device, durability tests were conduced for 1,000 to 20,000 times at an aqueous ink dropping rate of one drop/sec. The head was dismantled after 1,000 times, 5,000 times, 10,000 times and 20,000 times, and printing was conducted and the state was observed. The results are shown in Table 2. The respective marks shown in Table 2 show the states of the printing obtained, o indicating good state of printing, Δ the common state of printing, and x the bad state of printing. Judgement of goodness and badness of printing was conducted by both measurement of the deviated amount of the shot points of dots and organoleptic test by visual observation.

TABLE 2

| | 1000 times | 5000 times | 10000 times | 20000 times |
|---|---|---|---|---|
| Sample 4 | o | o | o | o |
| Sample 5 | o | o | o | Δ |
| Sample 6 | o | o | o | o |
| Sample 7 | o | o | o | Δ |
| Sample 8 | o | x | — | — |
| Sample 9 | o | x | — | — |

o . . . good
Δ . . . common
x . . . bad

As is apparent from the results shown in Table 2, the recording heads (Samples 8 and 9) of Comparative examples 2 and 3 became poorer in state of printing after 5,000 times of friction. This is because the surface treatment layer was peeled off. As compared with that, the heads (Samples 4–7) of Examples 3 to 6 were good or common in the state of printing even up to 20,000 times of friction.

As described above, since a surface treatment layer excellent in ink-liquid repellency and durability is formed at the orifice peripheral portion in the ink jet recording head of the present invention, constantly stable discharging printing can be done to give good printing.

Also, it has been found that the surface treatment layer is excellent in adhesion to both of organic and inorganic materials of the above durabilities in comparison with the conventional surface treatment layers, and therefore particularly useful for use in a conventional recording head in which plural kinds of organic and inorganic materials are used as the constituent materials of the orifice.

The present invention has substantiated unexpectedly good adhesiveness from the common sense in the technical field according to the conventional ink-liquid repellent treatment.

We claim:

1. An ink jet recording head having ink-liquid-repellent surface treatment portions close to the discharging ports, wherein said ink-liquid-repellent treatment surface portions are formed by polymerizing and curing a composition containing a fluorine type polymer with a molecular weight of 2,000 or more which is insoluble in water and soluble in organic solvent and a polyfunctional monomer and/or a polyfunctional oligomer having two or more (meth)acryloyl groups in the molecule through a silane coupling agent.

2. An ink jet recording head having ink-liquid-repellent surface treatment portions close to the discharging ports, wherein said ink-liquid-repellent surface treatment portions have a polymerization cured product of the following composition (a) and a polymerization cured product of the following composition (b):

composition (a):

a composition containing a fluorine type polymer with a molecular weight of 2,000 or more which is insoluble in water and soluble in organic solvent and a polyfunctional monomer and/or a polyfunctional oligomer having two or more (meth)acryloyl groups in the molecule;

composition (b)

a composition containing at least one of compounds having at least one reactive group selected from the group consisting of fluoroalkyl groups, fluoroallyl groups, fluorocycloalkyl groups, fluoroalkallyl groups and fluoroalkylallyl groups and a silazane group.

3. An ink jet recording head according to claim 1, in which said recording head discharges ink by utilization of heat energy.

4. An ink jet recording head according to claim 1, in which said discharging ports are equipped plurally.

5. An ink jet recording head according to claim 1, in which said recording head has an inkholding port for holding an ink as one body.

6. An ink jet recording head according to claim 1, in which said recording head has heat-generating elements.

7. An ink jet recording head according to claim 2, in which said recording head discharges ink by utilization of heat energy.

8. An ink jet recording head according to claim 2, in which said discharging ports are equipped plurally.

9. An ink jet recording head according to claim 2, in which said recording head has an ink-holding port for holding an ink as one body.

10. An ink jet recording head according to claim 2, in which said recording head has heat-generating elements.

11. A recording equipment performing record by ink on a recording medium, which comprises:

a recording means comprising discharging surfaces and discharging energy generators for generating energy utilized to discharge an ink from discharging ports, a carrying means for carrying the recording medium, and a driving means for driving the discharging energy generators, said discharging surfaces having ink-liquid-repellent surface treatment portions close to the discharging ports, and said ink-liquid-repellent surface treatment portions being formed by polymerizing and curing a composition containing a fluorine type polymer with a molecular weight of 2,000 or more which is insoluble in water and soluble in organic solvent and a polyfunctional monomer and/or a polyfunctional oligomer having two or more (meth)acryloyl groups in the molecule through a silane coupling agent.

12. A recording apparatus performing record by ink on a recording medium, which comprises:

a recording means comprising discharging surfaces and discharging energy generators for generating energy utilized to discharge an ink from discharging ports, a carrying means for carrying the recording medium, and a driving means for driving the discharging energy generators, said discharging surfaces having ink-liquid-repellent surface treatment portions close to the discharging ports, and said ink-liquid-repellent surface treatment portions having a polymerization cured product of the following composition (a) and a polymerization cured product of the following composition (b):

composition (a):

a composition containing a fluorine type polymer with a molecular weight of 2,000 or more which is insoluble in water and soluble inorganic solvent and a polyfunctional monomer and/or a polyfunctional oligomer having two or more (meth)acryloyl groups in the molecule;

composition (b):

a composition containing at lest one of compounds having at least one reactive group selected from the group consisting of fluoroalkyl groups, fluoroallyl groups, fluorocycloalkyl groups, fluoroalkallyl groups and fluoroalkylallyl groups and a silane group.

* * * * *

UNITED STATES PATENT AND TRADEMARK OFFICE

CERTIFICATE OF CORRECTION

PATENT NO. : 5,017,946

DATED : May 21, 1991

INVENTOR(S) : KAZUAKI MASUDA, ET AL.

It is certified that error appears in the above-identified patent and that said Letters Patent is hereby corrected as shown below:

COLUMN 1

Line 7, "July 20, 2989," should read --July 20, 1989,--.
Line 67, "bly" should read --ble--.

COLUMN 2

Line 7, "discharing" should read --discharging--.

COLUMN 3

Line 3, "has searched" should read --have searched for--.
Line 32, "is" (second occurrence) should be deleted and "that" (second occurrence) should be deleted.
Line 39, "peals" should read --peels--.

COLUMN 5

Line 8, "Referring" should read --Referring to--.
Line 11, "lowing," should read --lowing--.
Line 18, "portions" should read --portion--.
Line 50, "desirably" should read --desirably be--.

COLUMN 6

Line 27, "desirably" should read --desirably be--.
Line 61, "convertor" should read --convertors--.

UNITED STATES PATENT AND TRADEMARK OFFICE

CERTIFICATE OF CORRECTION

PATENT NO. : 5,017,946

DATED : May 21, 1991

INVENTOR(S) : KAZUAKI MASUDA, ET AL.

It is certified that error appears in the above-identified patent and that said Letters Patent is hereby corrected as shown below:

COLUMN 7

Line 33, "variation" should read --variations--.

COLUMN 8

Line 27, "manufacture" should read --manufactured--.
Line 41, "Fig. 4A" should read --Figs. 4A--.
Line 59, "conduced" should read --conducted--.

COLUMN 9

Line 52, "channels" should read --channel--.
Line 58, "channels" should read --channel--.

COLUMN 10

Line 41, "conduced" should read --conducted--.

COLUMN 11

Line 52, "(b)" should read --(b):--.
Line 66, "inkholding" should read --ink-holding--.

UNITED STATES PATENT AND TRADEMARK OFFICE

CERTIFICATE OF CORRECTION

PATENT NO. : 5,017,946

DATED : May 21, 1991

INVENTOR(S) : KAZUAKI MASUDA, ET AL.

It is certified that error appears in the above-identified patent and that said Letters Patent is hereby corrected as shown below:

COLUMN 12

Line 56, "inorganic" should read --in organic--.
Line 61, "lest" should read --least--.

Signed and Sealed this

Eighth Day of December, 1992

*Attest:*

DOUGLAS B. COMER

*Attesting Officer*

*Acting Commissioner of Patents and Trademarks*